US011590464B2

(12) United States Patent
Drake et al.

(10) Patent No.: US 11,590,464 B2
(45) Date of Patent: Feb. 28, 2023

(54) BOTTLE CAPABLE OF MIXING POWDERS AND LIQUIDS

(71) Applicant: ENDURAPHIN, INC., Binghamton, NY (US)

(72) Inventors: Daniel Drake, Cicero, NY (US); Michael Dalberth, Clay, NY (US)

(73) Assignee: ENDURAPHIN, INC., Binghamton, NY (US)

( * ) Notice: Subject to any disclaimer, the term of this patent is extended or adjusted under 35 U.S.C. 154(b) by 151 days.

(21) Appl. No.: 16/832,235

(22) Filed: Mar. 27, 2020

(65) Prior Publication Data

US 2020/0316540 A1 Oct. 8, 2020

Related U.S. Application Data

(63) Continuation of application No. 15/535,584, filed as application No. PCT/US2015/065734 on Dec. 15, 2015, now abandoned.

(60) Provisional application No. 62/091,919, filed on Dec. 15, 2014.

(51) Int. Cl.

| | |
|---|---|
| ***B65D 1/02*** | (2006.01) |
| ***B65D 23/04*** | (2006.01) |
| ***B01F 33/501*** | (2022.01) |
| ***B65D 1/44*** | (2006.01) |
| ***B01F 23/50*** | (2022.01) |
| *B01F 101/14* | (2022.01) |

(52) U.S. Cl.

CPC ..... *B01F 33/50111* (2022.01); *B01F 23/50* (2022.01); *B65D 1/0207* (2013.01); *B65D 1/0223* (2013.01); *B65D 1/44* (2013.01); *B65D 23/04* (2013.01); *B01F 2101/14* (2022.01)

(58) Field of Classification Search

CPC ..... B01F 13/0022; B01F 33/50111; B65D 1/0223; B65D 23/04

USPC ..... 366/130; 215/383, 384

See application file for complete search history.

(56) References Cited

U.S. PATENT DOCUMENTS

| | | | | |
|---|---|---|---|---|
| 45,309 | A | 12/1864 | Bliss | |
| D7,181 | S | 2/1874 | Durkee | |
| 274,995 | A | 4/1883 | Toussaint | |
| D72,960 | S | 6/1927 | Mas | |
| 1,770,093 | A | 7/1930 | West | |
| 1,835,252 | A * | 12/1931 | West | B65D 1/0223 222/547 |
| D97,102 | S | 10/1935 | Smith | |
| D199,204 | S | 9/1964 | Dailey | |
| 3,185,353 | A | 5/1965 | Mercier | |
| D252,497 | S | 7/1979 | Courreges | |
| D363,027 | S | 10/1995 | Mansau | |
| 5,803,290 | A | 9/1998 | Bongiorno | |
| D399,754 | S | 10/1998 | Bertolini | |
| D407,649 | S | 4/1999 | McCallister | |

(Continued)

*Primary Examiner* — David L Sorkin

(74) *Attorney, Agent, or Firm* — Burns & Levinson LLP; Bruce D. Jobse

(57) ABSTRACT

A bottle includes a base, neck that defines an aperture, and a body. The bottle has at least one indent in the body that projects into an interior of the bottle and extends around at least part of a circumference of the body. This at least one indent is configured to agitate a substance contained in the bottle. For example, the bottle may contain a powder, such as protein powder, and the at least one indent helps mix the powder with a liquid. In an example, two indents are used in the bottle.

18 Claims, 11 Drawing Sheets

(56) References Cited

U.S. PATENT DOCUMENTS

| | | | | |
|---|---|---|---|---|
| D447,697 | S | 9/2001 | Schultz | |
| D464,267 | S | 10/2002 | Mixon | |
| 6,497,333 | B1 | 12/2002 | Ellis et al. | |
| D482,625 | S | 11/2003 | Crawford | |
| 6,695,162 | B1 | 2/2004 | Boukobza et al. | |
| D520,372 | S | 5/2006 | Andoh | |
| D523,346 | S | 6/2006 | Andoh | |
| 7,097,060 | B2 * | 8/2006 | Penny | B65D 1/0223 215/384 |
| 7,172,087 | B1 | 2/2007 | Axe et al. | |
| D544,364 | S | 6/2007 | Archeny | |
| D551,984 | S | 10/2007 | La Kier | |
| D579,781 | S | 11/2008 | Granitz | |
| D581,282 | S | 11/2008 | Lepoitevin | |
| D598,296 | S | 8/2009 | Serrano Diaz | |
| D598,771 | S | 8/2009 | Kissinger | |
| D601,426 | S | 10/2009 | Darr | |
| D605,048 | S | 12/2009 | Smith | |
| D610,018 | S | 2/2010 | Zoppas | |
| D612,256 | S | 3/2010 | Wurster | |
| 7,862,841 | B1 | 1/2011 | Boyd et al. | |
| D664,855 | S | 8/2012 | Teitelbaum | |
| D692,306 | S | 10/2013 | Lee | |
| D714,154 | S | 9/2014 | Keeler | |
| 8,870,006 | B2 | 10/2014 | Kamineni et al. | |
| 8,910,812 | B2 | 12/2014 | Pedmo | |
| 9,150,331 | B2 | 10/2015 | Kisela | |
| D759,490 | S | 6/2016 | Cetnar | |
| D779,885 | S | 2/2017 | Crowder | |
| D782,318 | S | 3/2017 | Sanghavi | |
| D784,139 | S | 4/2017 | Robinson | |
| D784,145 | S | 4/2017 | Robinson | |
| D784,817 | S | 4/2017 | Heisner | |
| D802,429 | S | 11/2017 | Wiliiams | |
| D803,692 | S | 11/2017 | Enxing | |
| 2004/0026355 | A1 * | 2/2004 | Headen | B29C 49/48 215/382 |
| 2006/0051491 | A1 | 3/2006 | Levitt | |
| 2007/0199916 | A1 | 8/2007 | Denner et al. | |
| 2009/0255893 | A1 * | 10/2009 | Zummo | B65D 1/0223 215/10 |
| 2013/0306660 | A1 | 11/2013 | Bysick et al. | |
| 2018/0310771 | A1 | 11/2018 | Hellmann | |

* cited by examiner

BOTTLE CAPABLE OF MIXING POWDERS AND LIQUIDS

CROSS-REFERENCE TO RELATED APPLICATIONS

This application claims priority to the provisional patent application filed Dec. 15, 2014 and assigned U.S. App. No. 62/091,919, the disclosure of which is hereby incorporated by reference.

FIELD OF THE DISCLOSURE

This disclosure relates to bottles and, more particularly, to bottles capable of mixing powders and liquids.

BACKGROUND OF THE DISCLOSURE

The sports nutrition market is worth billions of dollars per year and is projected to grow as interest among consumers increases. Protein powders make up a majority of this market. Whereas sports nutrition was previously of interest mainly to elite athletes or bodybuilders, more average consumers, including casual exercisers and amateur athletes, are paying attention to sports nutrition. More consumers are becoming interested in protein for reasons such as muscle mass growth or maintenance, recovery from exercise, bone health, skin health, nail health, hair health, feeling full or sated after or between meals, or providing low-calorie energy without caffeine.

Protein powder is generally sold in large tubs. These tubs are inconvenient to transport or dispense. Consumers generally bring a small amount of protein powder with them to, for example, the gym. Consumers then mix the protein powder with, for example, water or milk on-site. It can be cumbersome to bring a hag or container of protein powder with you because of the risk of spillage in, for example, a gym bag with clothes and shoes for exercising. It also can be difficult to transfer the protein powder from the bag or container into a bottle without spilling because of the narrow opening on the top of the bottle. Any spillage or other loss of protein powder can affect the nutritional value, consistency, or health benefits of the resulting mixture.

Some consumers use a reusable bottle to transport and/or mix protein powder. However, these reusable bottles for mixing protein powder have many drawbacks. Reusable bottles for mixing protein powder are typically difficult to clean due to complex interiors or agitator(s). If such a reusable bottle is not fully cleaned, then it begins to smell and may become unusable. The agitator, which can be a blender ball, may become lost, which renders the reusable bottle useless. Other reusable bottles may become damaged due to high or low temperatures, such as cracking if stored in a vehicle parked outside during winter months or deformation caused by a dishwashing machine. Consumers may need to purchase new reusable bottles on a periodic basis due to cleanliness issues, lost agitators, or other damage.

To avoid bringing protein powder and/or a reusable bottle, pre-mixed protein shakes are available. However, these pre-mixed protein shakes are perishable, require refrigeration, are more expensive than the protein powder alone, may use lower-quality powder than is sold to consumers in large tubs, and typically contain large amounts of sodium. The need for refrigeration makes transport or storage difficult for consumers. The amount of sodium in a pre-mixed protein shake can be a health concern for certain consumers. The consistency of pre-mixed protein shakes is constant, and this consistency is not universally appealing to consumers.

Whether a consumer mixes protein powder in a reusable bottle specifically marketed for mixing protein powder or in a regular disposable bottle (e.g., a disposable water bottle), the mixing may be incomplete or insufficient. For example, an insufficiently mixed protein shake may be grainy or gritty. Clumps of protein powder also may remain in the mixture. These clumps of protein powder are unappetizing to the consumer and may not be consumed, leading to wasted product.

Therefore, what is needed is a disposable bottle capable of mixing a powder and liquid and, more particularly, for mixing protein powder.

BRIEF SUMMARY OF THE DISCLOSURE

In a first embodiment, a bottle is provided. The bottle includes a base, a neck defining an aperture, a body disposed between the base and the neck, and at least one indent in the body that projects into an interior of the bottle. The body defines an outer surface and an inner surface. The at least one indent extends around at least part of a circumference of the body. The indent defines a cavity in the outer surface of the bottle. From the inner surface of the body to a farthest point of the indent into the interior, the indent projects into the interior of the bottle at least 15% of a radius from the inner surface to a center of the body as measured in a plane. The indent is configured to agitate a substance contained in the bottle.

The base, the neck, and the body can be fabricated of HDPE plastic.

The inner surface of the body may have a first diameter where the body connects with the neck and a second diameter where the body connects with the base. The second diameter is smaller than the first diameter.

The indent can extend less than or equal to 75% around the circumference of the body. The body can defines a region on the inner surface of the bottle between a pair of circumferential ends of the indent. The region is uninterrupted by the indent. The indent also can extend entirely around the circumference of the body. A depth the indent projects into the interior may be greater than an outer longitudinal height of the cavity on the outer surface of the body. The indent can have a rounded tip on the inner surface at a farthest point the indent projects into the interior. The indent can have planar regions between the tip and the outer surface of the bottle. The indent may project into the interior at an angle substantially parallel with a planar surface of the base.

The neck can define threads and is configured to retain a cap. The aperture can define an aperture inner diameter and the indent can form an inner diameter between two surfaces of the indent. The inner diameter is larger than the aperture inner diameter.

The body can have a wall thickness from 0.8 mm to 2 mm

The bottle may include at least one baffle disposed on the base projecting into the interior of the bottle.

The bottle may include at least two of the indent in the body. The at least two indents can project into the interior to different depths. The at least two indents also can project into the interior to a same depth. There may be a first dimension between the base and one of the indents and a second dimension between the indents. The first dimension can be configured to provide a first volume of 4.5 fluid ounces in the body. The second dimension can be configured to provide a second volume of 5.5 fluid ounces in the body.

In a second embodiment, a method is provided. A bottle is provided. The bottle includes a base, a neck defining an aperture, a body disposed between the base and the neck, and at least one indent in the body that projects into an interior of the bottle. The body defines an outer surface and an inner surface. The at least one indent extends around at least part of a circumference of the body. The indent defines a cavity in the outer surface of the bottle. From the inner surface of the body to a farthest point of the indent into the interior, the indent projects into the interior of the bottle at least 15% of a radius from the inner surface to a center of the body as measured in a plane. The indent is configured to agitate a substance contained in the bottle. The bottle is filled with protein powder. A cap is disposed on the neck of the bottle over the aperture. The protein powder may occupy less than 10% of a volume of the interior of the bottle after the filling and before the disposing.

In a third embodiment, a powder transport container is provided. The powder transport container includes a bottle and a volume of protein powder in the bottle. The bottle includes a base, a neck defining an aperture, a cap disposed on the neck over the aperture, a body disposed between the base and the neck, and at least one indent in the body that projects into an interior of the bottle. The body defines an outer surface and an inner surface. The at least one indent extends around at least part of a circumference of the body. The indent defines a cavity in the outer surface of the bottle. From the inner surface of the body to a farthest point of the indent into the interior, the indent projects into the interior of the bottle at least 15% of a radius from the inner surface to a center of the body as measured in a plane. The indent is configured to agitate a substance contained in the bottle. The volume of protein powder may be less than 10% of a volume of the interior of the bottle.

DESCRIPTION OF THE DRAWINGS

For a fuller understanding of the nature and objects of the disclosure, reference should be made to the following detailed description taken in conjunction with the accompanying drawings, in which.

DETAILED DESCRIPTION OF THE DISCLOSURE

Although claimed subject matter will be described in terms of certain embodiments, other embodiments, including embodiments that do not provide all of the benefits and features set forth herein, are also within the scope of this disclosure. Various structural, logical, and process step changes may be made without departing from the or scope of the disclosure. Accordingly, the scope of the disclosure is defined only by reference to the appended claims.

Embodiments of the bottle disclosed herein provide improved mixing of a powder and liquid. These bottles may be pre-filled and disposable, which reduces the need for a consumer to transport powder or a reusable bottle. The bottles can be recyclable, which reduces impact on the environment. The bottles are advantageous in particular for protein powder because a bottle embodiment disclosed herein containing protein powder does not require refrigeration and is easy to ship and store. As only the protein powder may be stored in the bottle and this protein powder can be shelf-stable, then a resulting mixture may have lower sodium content than pre-mixed protein shakes.

Figure 1:
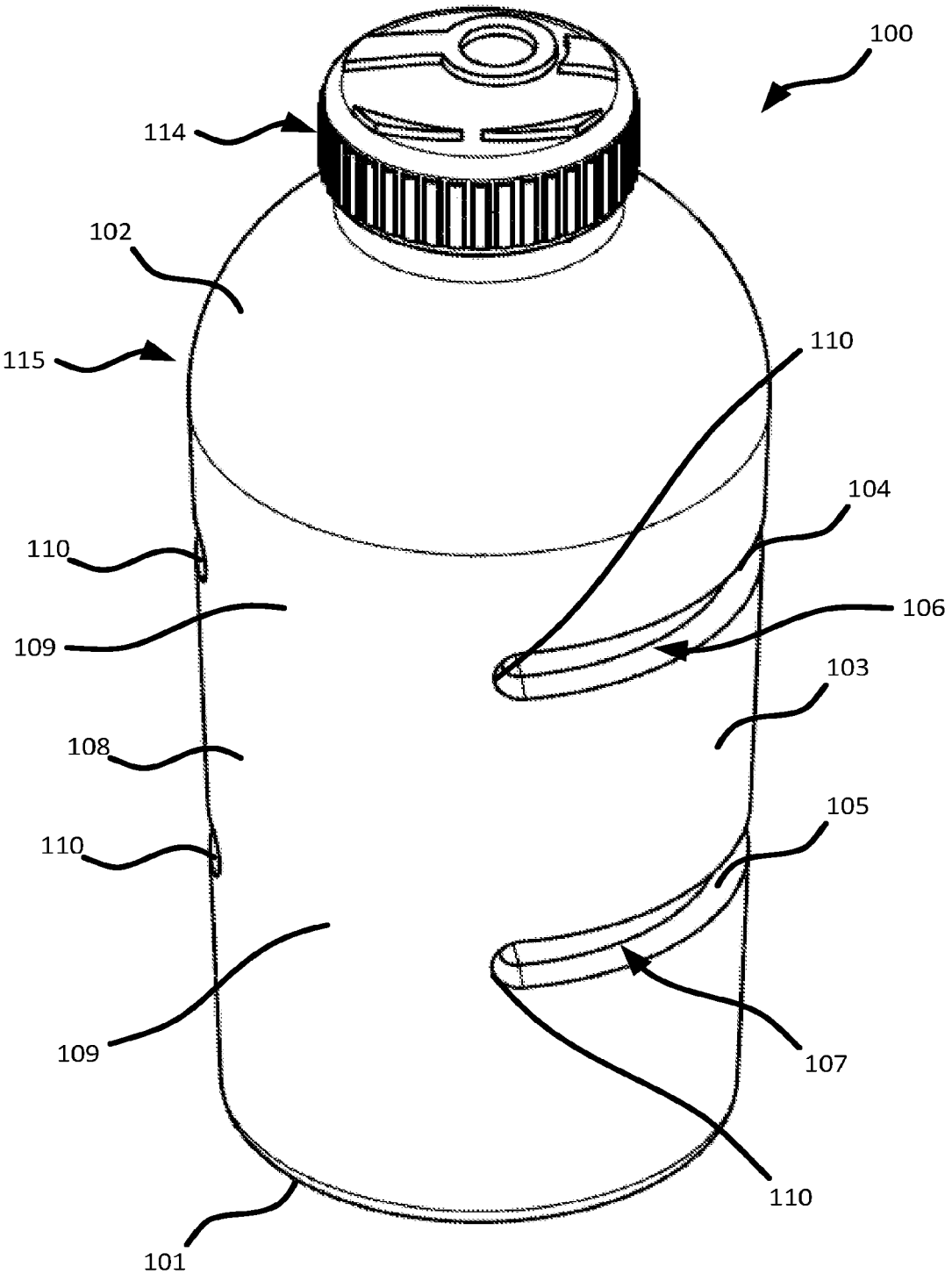
FIG. 1 is a perspective view of an embodiment of a bottle in accordance with the present disclosure.
Figure 2:
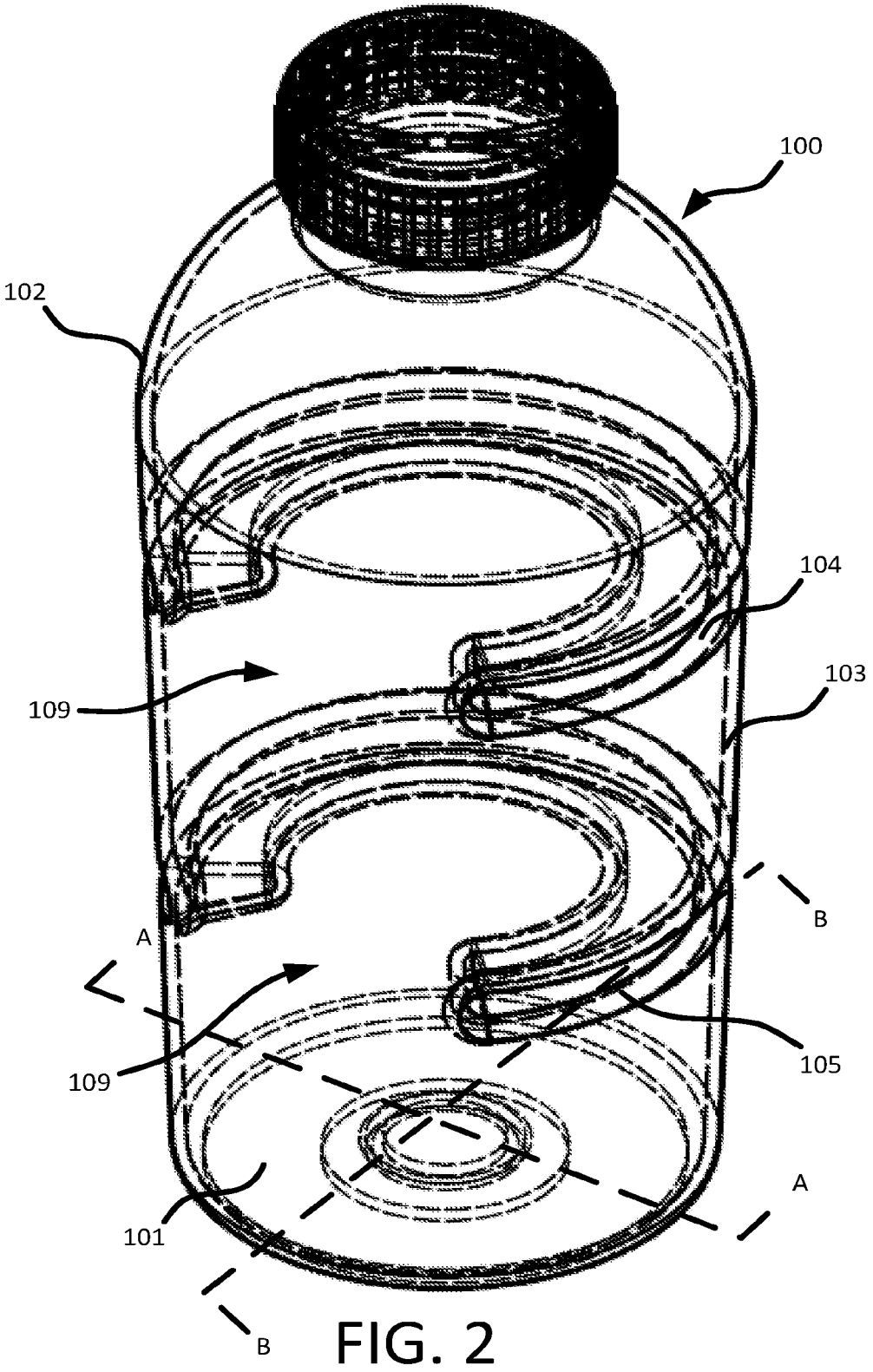
FIG. 2 is a wire frame perspective view of the bottle of FIG. 1.

FIG. 1 is a perspective view of an embodiment of a bottle 100 and FIG. 2 is a wire frame perspective view of the bottle 100 of FIG. 1. The bottle 100 includes a base 101, a neck 102, and a body 103. The body 103 is between the base 101 and the neck 102. In an example, the body 103 connects directly to the neck 102 and base 101. The neck 102 can be flared or curved as seen in FIG. 1 or 2. The neck 102 may include a top section 114, in which the aperture 113 is located, and a connecting section 115, which connects the top section 114 to the body 103. The connecting section 115 may be curved, angular, or planar.

At least one indent projects into the interior of the bottle 100. As seen in FIGS. 1 and 2, a first indent 104 and second indent 105 project into the interior of the bottle 100. The first indent 104 and second indent 105 extend around at least part of a circumference of the body 103. The first indent 104 and second indent 105 may not extend around the full circumference of the body 103. The first indent 104 and second indent 105 also may extend around the full circumference of the body 103 or more than the full circumference of the body 103 (e.g., the ends may overlap in a spiral pattern or other pattern).

The first indent 104 defines a first cavity 106 on the outer surface 108 of the bottle 100. The second indent 105 defines a second cavity 107 on the outer surface 108 of the bottle 100. More or fewer indents are possible than the first indent 104 and second indent 105 seen in FIG. 1. Each of the first cavity 106 and second cavity 107 can provide better grip on the bottle for a consumer and can reduce the material necessary to manufacture the bottle 100 compared to a bottle where the first cavity 106 or second cavity 107 are filled in. However, the first cavity 106 and/or second cavity 107 may not be included with the first indent 104 or second indent 105, respectively, and the space of the first cavity 106 and/or second cavity 107 may be filled in.

Each of the first indent 104 and second indent 105 is configured to agitate a substance contained in the bottle 100. For example, the first indent 104 and second indent 105 may be used to mix a powder with a liquid, such as protein powder with water or milk.

In the embodiment of the bottle 100 in FIGS. 1 and 2, the first indent 104 and second indent 105 do not extend around an entire circumference of the body 103. The body 103 defines a region 109 between each part of the circumferential ends 110 of the first indent 104 and second indent 105. Thus, the region 109 is uninterrupted by the first indent 104 and second indent 105. The region 109 can provide a place where flow of liquid from the bottle 100 is not obstructed or impeded by the first indent 104 or second indent 105.

Figure 3:
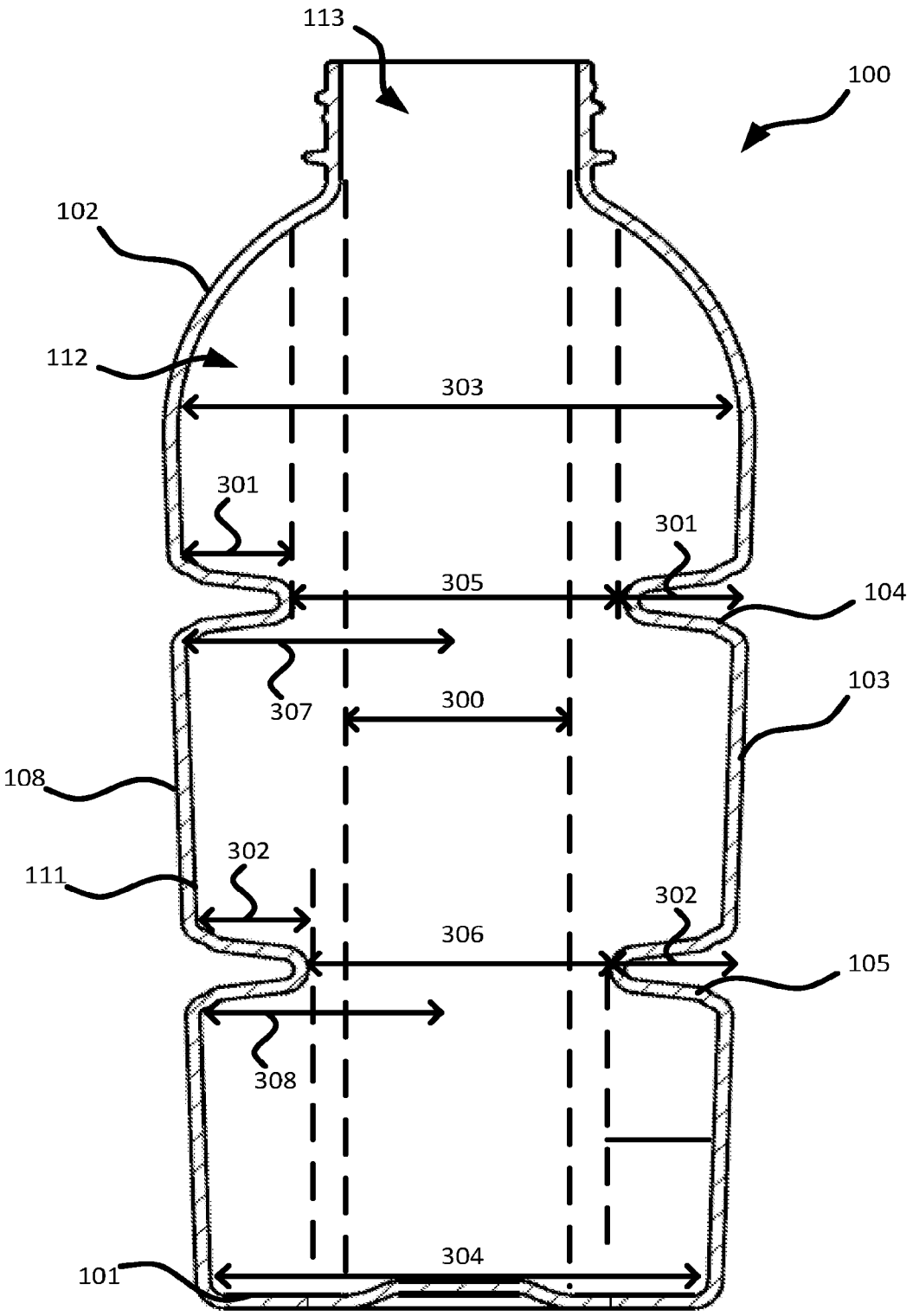
FIG. 3 is a cross-sectional view of the bottle of FIG. 1 along line A-A in FIG. 2.

FIG. 3 is a cross-sectional view of the bottle 100 of FIG. 1 along line A-A in FIG. 2. As seen in FIG. 3, the bottle 100, including the base 101, neck 102, and body 103, has an outer surface 108 and an inner surface 111. The wall thickness between the outer surface 108 and inner surface 111 in at least the body 102 of the bottle 100 can be from approximately 0.5 mm to 5.5 mm or, more particularly, approximately 0.8 mm to 2 mm. The wall thickness can vary between or within, for example, the base 101, neck 102, and body 103. The wall thickness also can be uniform throughout, for example, the base 101, neck 102, and body 103. In an example, this wall thickness is approximately 1.8 mm throughout the base 101, neck 102, and body 103. The wall thickness can vary, but should be thick enough to reduce a risk of cracking or breakage of the bottle 100. Other wall thicknesses are possible to maintain rigidity for use while minimizing material for manufacturing, which may be beneficial because the bottle 100 may be disposable. A relatively thin wall thickness may reduce material used in manufacturing and reduce manufacturing costs. A relatively thin wall thickness also can imply to a consumer that the bottle 100 is disposable. A bottle 100 configured to be reusable may have a thicker wall thickness than a bottle 100 configured to be disposable.

The neck 102 includes an aperture 113. The aperture 113 and neck 102 are configured to enable the bottle 100 to be filled with powder, liquid, or other substance and for a consumer to consume (e.g., drink) or pour from the bottle 100.

Each of the first indent 104 and second indent 105, as measured from the inner surface 111 of the body 103 to a farthest point of the first indent 104 or second indent 105 into the interior 112, projects into the interior 112 of the bottle 100 at least 15% of a radius from the inner surface 111 of the body 103 to a center of the body 103 as measured in a plane. This distance can measure from where the inner surface 111 of the first indent 104 or second indent 105 connects with the inner surface 108 of the body 103. The plane may be parallel to the base 101 or at other angles. For example, each of the first indent 104 and second indent 105 projects into the interior 112 of the bottle 100, as measured from the inner surface 111 of the body 103 to a farthest point of the first indent 104 or second indent 105 into the interior 112, at least 15%, 20%, 25%, 50%, 75%, or 99% of a radius from the inner surface 111 of the body 103 to a center of the body 103 as measured in a plane. The first indent 104 and second indent 105 may project into the interior 112 to a depth that provides effective mixing of a liquid and powder without obstructing a consumer's ability to consume or pour from the bottle 100.

The distance that an indent, such as the first indent 104 and second indent 105, projects into the interior 112 of the bottle 100 can vary at different positions of the indent.

The first indent 104 projects into the interior 112 of the bottle 100 by a first dimension 301. The second indent 105 projects into the interior 112 of the bottle 100 by a second dimension 302. The first dimension 301 and the second dimension 302 can be the same or can be different. Thus, each indent, such as the first indent 104 and second indent 105, can project into the interior 112 of the bottle 100 the same distance or different distances. The first dimension 301 or second dimension 302 may be used to calculate the percentage of the radius from the inner surface 111 of the body 103 to a center point of the body 103 as measured in a plane (such as along first radius 307 or second radius 308).

By projecting at least 15% of a radius from the inner surface 111 of the body 103 to a center point of the body 103, the first indent 104 and second indent 105 provide improved mixing of a powder with a liquid, such as protein powder with water or milk. Projecting less than 15% from the inner surface 111 of the body 103 to a center point of the body 103 can lead to insufficient mixing, which may result in a mixture with grainy consistency or clumps in the mixture.

The walls of the aperture 113 define an inner diameter 300 into the bottle 100. The space between the farthest points of the inner surface 111 of the first indent 104 into the body 103 defines a first inner diameter 305. The space between the farthest points of the inner surface 111 of the second indent 105 into the body 103 defines a second inner diameter 306. The first inner diameter 305 and second inner diameter 306 measures to a depth that the first indent 104 or second indent 105, respectively, project into the interior 112 of the bottle 100. The first inner diameter 305 plus each of the first dimension 301 and wall thickness of the body 103 on the cross-section can equal total diameter to the outer surface 108 of the bottle 100. The second inner diameter 306 plus each of the second dimension 302 and wall thickness of the body 103 on the cross-section can equal a total diameter of the outer surface 108 of the bottle 100. These dimensions and diameters assume that each of the first indent 104 or second indent 105 are located on both sides of the body 103 in a cross-sectional view. In such an instance, the first inner diameter 305 and second inner diameter 306 are equal to or larger than the aperture inner diameter 300 along the same axis. Thus, there may be a gap between the first dimension 301 and/or second dimension 302 and the inner diameter 300 or the first dimension 301 and/or second dimension 302 can extend up to the inner diameter 300. Even if the cross-section of the bottle 100 does not include one or more indents on both sides of the bottle 100, the indent(s) can extend up to the inner diameter 300. This enables the bottle 100 to be filled because the first indent 104 and second indent 105 do not obstruct a filling mechanism that can be lowered into the bottle 100 to add powder or another substance. The width of a filling mechanism can be smaller than the inner diameter 300, so the first indent 104 and second indent 105 can extend beyond the inner diameter 300 in an instance.

The inner surface 111 of the bottle 100 has a first diameter 303 where the body 103 connects with the neck 102 and a second diameter 304 where the body 103 connects with the base 101. The second diameter 304 can be smaller than the first diameter 303. This design of bottle 100 with a smaller diameter 304 may improve mixing. One possible mechanism for this improvement is that the fluid in the bottle 100 is forced into a smaller area proximate the base 101, which increases the velocity of the fluid and can aid in breaking up clumps of the powder when these clumps hit the first indent 104 or second indent 103. Other mixing mechanisms are possible and this is merely one example. This design of bottle 100 with a smaller diameter 304 also may reduce the amount of material needed to manufacture the bottle 100.

Alternatively, the first diameter 303 can be smaller than the second diameter 304 or the first diameter 303 and second diameter 304 can be the same.

In an example, the first diameter 303 is approximately 74 mm and the second diameter 304 is approximately 66 mm. These diameters are merely examples and other diameters are possible.

The outer diameter of the bottle 100 measured using the outer surface 108 can be narrowed from the neck 102 to the base 101, narrowed from the base 101 to the neck 102, or be the same from the neck 102 to the base 101. Even if the bottle 100 is generally flared between the base 101 and the neck 102 or is the same between the base 101 and the neck 102, the outer diameter can vary due to the first cavity 106 of the first indent 104 and/or the second cavity 107 of the second indent 105. Other designs of the outer surface 108 are possible. Thus, the outer diameter of the outer surface 108 may vary between the neck 102 and the base 101, such as having multiple segments or sections of different diameters.

Figure 4:
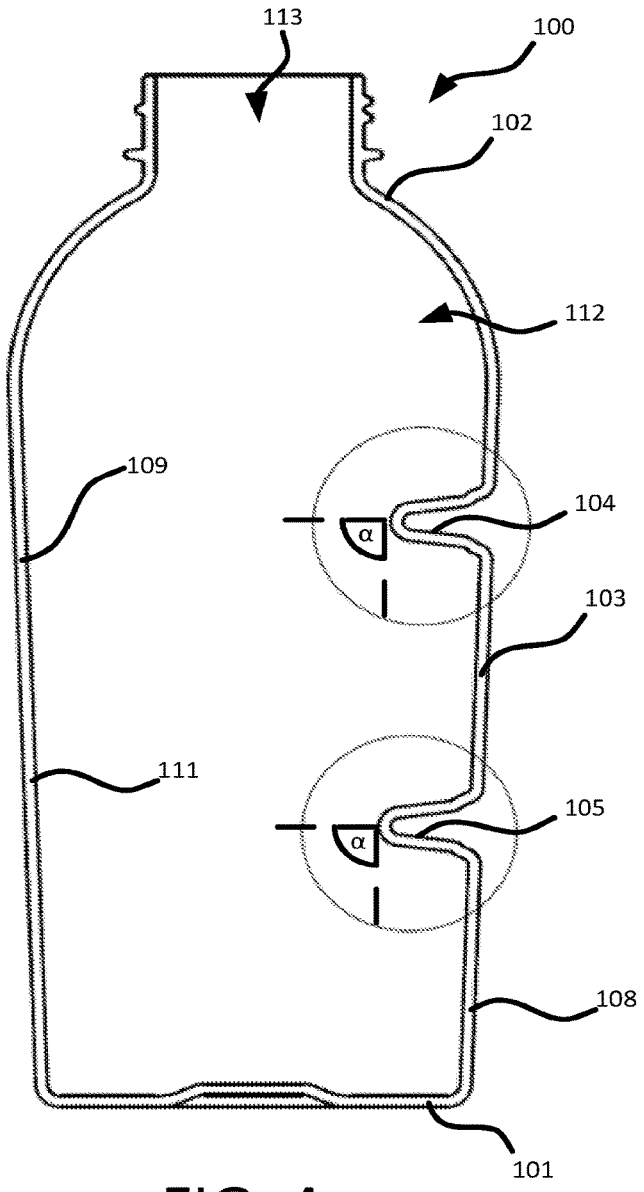
FIG. 4 is a cross-sectional view of the bottle of FIG. 1 along line B-B in FIG. 2.

FIG. 4 is a cross-sectional view of the bottle 100 of FIG. 1 along line B-B in FIG. 2. The region 109 is opposite the first indent 104 and second indent 105 in this cross-sectional view. As seen in FIG. 4, the region 109 has a smooth, uninterrupted surface on the inner surface 111 of the bottle 100, though other designs or configurations for the region 109 are possible provided these other designs or configurations obstruct fluid flow during pouring or consumption to a lesser extent than that of the indent or indents in the bottle 100. The region 109 can include features such as, for example, bumps or ribs. These features may be smaller than or extend into the body 103 less than the first indent 104 or second indent 105.

As seen in FIG. 4, the first indent 104 and second indent 105 project into the interior 112 at an angle $\alpha$ substantially parallel with a planar surface of the base 101. However, a can vary. Each of the first indent 104 and second indent 405 also can project at an upward angle toward the neck 102 or a downward angle toward the base 101.

The first indent 104 and second indent 105 are illustrated as being generally parallel to the base 101. This shape or pattern can vary. For example, the first indent 104 and/or second indent 105 can have an angular trajectory that is not parallel to the base 101 such that one end of the first indent 104 and/or second indent 105 is closer to the neck 102 and the other end of the first indent 104 and/or second indent 105 is closer to the base 101. The first indent 104 and/or second indent 105 also can form a spiral, zig-zag, or other curved pattern on the body 103.

Figure 5:
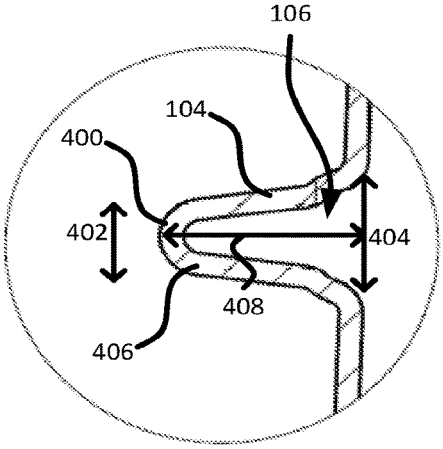
FIG. 5 is a detail view of the first indent of the bottle of FIG. 4.
Figure 6:
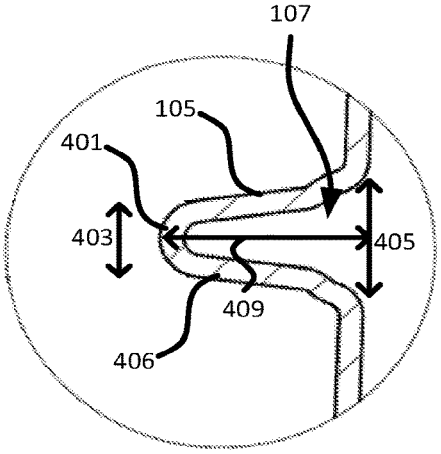
FIG. 6 is a detail view of the second indent of the bottle of FIG. 4.

FIG. 5 is a detail view of the first indent 104 of the bottle 100 of FIG. 4. FIG. 6 is a detail view of the second indent 105 of the bottle 100 of FIG. 4. The first indent 104 has a first tip 400 and the second indent 105 has a second tip 401. The first tip 400 and second tip 401 may be the farthest point that the inner surface 109 of the first indent 104 or second indent 105 projects into the interior 112 of the bottle 100. The first tip 400 and second tip 401 may extend to different depths into the interior 112 of the bottle 100 or to the same depth into the interior 112 of the bottle 100. For example, in FIG. 4 the first indent 104 and second indent 105 extend to approximately the same depth in the bottle, but the first indent 104 and second indent 105 extend into the bottle 100 to different depths because the bottle 100 is flared. Having the first indent 104 and second indent 105 extend into the bottle 100 to different depths may provide increased turbulence and improve a resulting mixture.

The first tip 400 or second tip 401 may be rounded as seen in FIGS. 5 and 6. The first tip 400 or second tip 401 also may be other shapes, such as square or angled. A more angled first tip 400 and/or second tip 401 than those illustrated in FIG. 5 or FIG. 6 may be less rigid but may provide improved mixing. The wall thickness of the body 108 around the first tip 400, second tip 401, first indent 104, or second indent 105 may be configured to reduce propensity for splitting or cracking of the bottle 100 such as by making this wall thickness thicker.

The first indent 104 has a first outer longitudinal height 404 of the first cavity 106 on the outer surface 108 of the body 103. The second indent 105 has a second outer longitudinal height 405 of the second cavity 107 on the outer surface 108 of the body 103. The depth the first indent 104 or second indent 105 projects into the interior 112 of the bottle 100 (e.g., the first dimension 301 or second dimension 302) may be greater than a respective first outer longitudinal height 404 or second outer longitudinal height 405.

The first tip 400 has a first tip height 402. The second tip 401 has a second tip height 403. The first tip height 402 and second tip height 403 are measured relative to the inner surface 111 of the bottle 100. The first tip height 402 is less than the first outer longitudinal height 404. The second tip height 403 is less than the second outer longitudinal height 405.

One or both of the first indent 104 and the second indent 105 can include planar regions 406 between the tip, such as tip 400 or tip 401, and the outer surface 108 of the bottle 100. As seen in FIGS. 5 and 6, each of the first indent 104 and second indent 105 include a curved region between the planar regions 406 and the outer surface 108 of the body 103. A first indent 104 and/or second indent 105 can be configured to not include this curved region.

The planar regions 406 are illustrated in FIGS. 5 and 6 as being non-parallel. For example, a pair of planar regions 406 in the first indent 104 or second indent 105 may be angled from approximately 0° and 75° or, more particularly, from 3° and 15° relative to the other. The indents, such as the first indent 104 and second indent 105, may have a pitch factor around the entrance so that a mold can be extracted. Thus, the first indent 104 and second indent 105 may not have a 0° pitch.

In an example, the first outer longitudinal height 404 or second outer longitudinal height 405 are approximately 4 mm and the third dimension 408 and the fourth dimension 409 are approximately 10 mm, as measured from an outer surface 108 of the body 103 to a farthest point the first indent 104 or the second indent 105 projects into the interior 112. However, the third dimension 408 and the fourth dimension 409 may have different depths than this example.

The first outer longitudinal height 404 and second outer longitudinal height 405 can be the same or different. The first outer longitudinal height 404 or second outer longitudinal height 405 can vary in height to improve mixing, improve a consumer's grip, or reduce material used in manufacturing. A larger first outer longitudinal height 404 or second outer longitudinal height 405 may use more material and may make the first indent 104 or second indent 105 less rigid, but may make the bottle 100 more ergonomic for a consumer to hold. A smaller first outer longitudinal height 404 or second outer longitudinal height 405 may use less material and may make the first indent 104 or second indent 105 more rigid, but may make the bottle 100 less ergonomic for a consumer to hold. However, a consumer's grip can vary by a consumer's age, finger size, strength of grip, or other factors.

Figure 7:
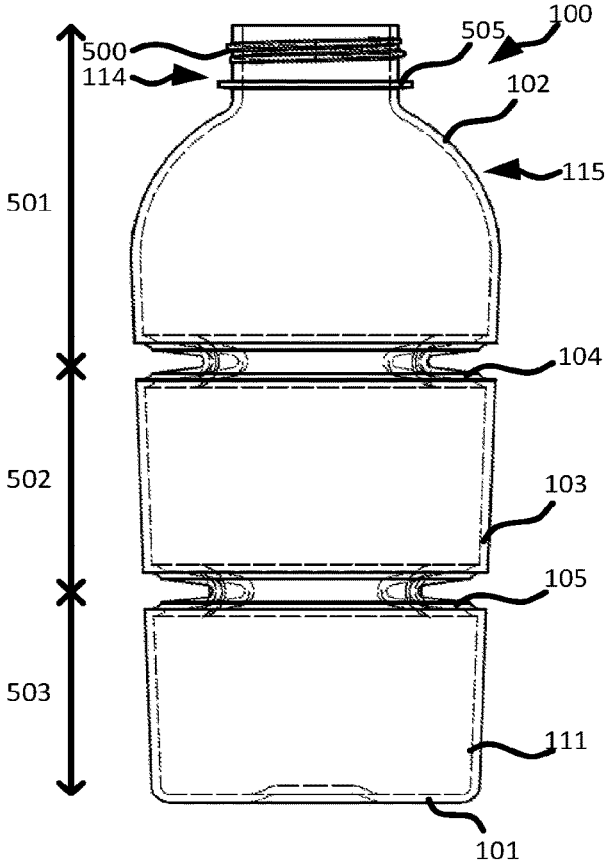
FIG. 7 is a back view of the bottle of FIG. 1.

FIG. 7 is a back view of the bottle 100 of FIG. 1. The neck 102 can define threads 500 configured to retain a cap (such as the cap 504 illustrated in FIG. 9) and can define a rim 505 that the cap may be disposed against. The threads 500 and rim 505 may be disposed on the top section 114 of the neck 102. The curvature of the neck 102 between the body 103 and the region including the threads 500 can vary. The width of the top section 114 including the threads 500 may vary to accommodate a particular cap.

Between a top of the neck region 114 of the neck 102 including the threads 500 (e.g., the top of the bottle 100) and a center of the first indent 104 is a first height 501. Between the center points of the first indent 104 and second indent 105 is a second height 502. Between a center of the second indent 105 and an inner surface 111 of the base 101 is a third height 503.

In an example, the third height 503 is configured to provide a volume of approximately 4.5 fluid ounces (0.13 liters) in the body 103 and the second height 502 is configured to provide a volume of approximately 5.5 fluid ounces (0.15 liters) in the body. Thus, the body 103 from the base 101 to the first indent 104 can provide a volume of approximately 10 fluid ounces (0.3 liters). These dimensions may enable the mixture of liquid and powder to gain velocity and impact the inner surface 111, including the first indent 104 and second indent 105, as the bottle 100 is shaken.

The first height 501, second height 502, and third height 503 can vary to improve mixing, improve ease of manufacturing, reduce material usage during manufacturing, or other reasons. For example, the third height 503 can be smaller than that illustrated in FIG. 7 such that the second indent 105 is more proximate the base 101. The first height 501 can be smaller than that illustrated in FIG. 7 such that the first indent 104 is more proximate the neck 102 or is more proximate the top section 114 including the threads 500. The second height 502 can be smaller than that illustrated in FIG. 7 such that the first indent 104 and second indent 105 are more proximate each other. The first height 501, second height 502, and third height 503 also can be larger than that illustrated in FIG. 7.

In an instance, first height 501 is approximately 74.4 mm, second height 502 is approximately 50.8 mm, and third height 503 is approximately 46.8 mm. These heights are exemplary and other values for the first height 501, second height 502, and third height 503 are possible.

The second height 502 may be configured to prevent a clump of the mixture from becoming lodged between the first indent 104 and second indent 105, which would reduce or otherwise affect the amount or nutritional value of the mixture that a consumer could consume or pour from the bottle 100.

The first height 501, second height 502, and third height 503 can be configured for improved grip by a consumer or ergonomics.

In an example, the bottle 100 can hold approximately 16 fluid ounces (0.47 liters). However, this volume can vary. In an example, the volume of the bottle 100 may be less than 67.6 fluid ounces (2 liters). For example, the bottle 100 can be configured to hold from 2 to 6 fluid ounces (0.06 liters to 0.18 liters) or 24 fluid ounces (0.71 liters).

Figure 8:
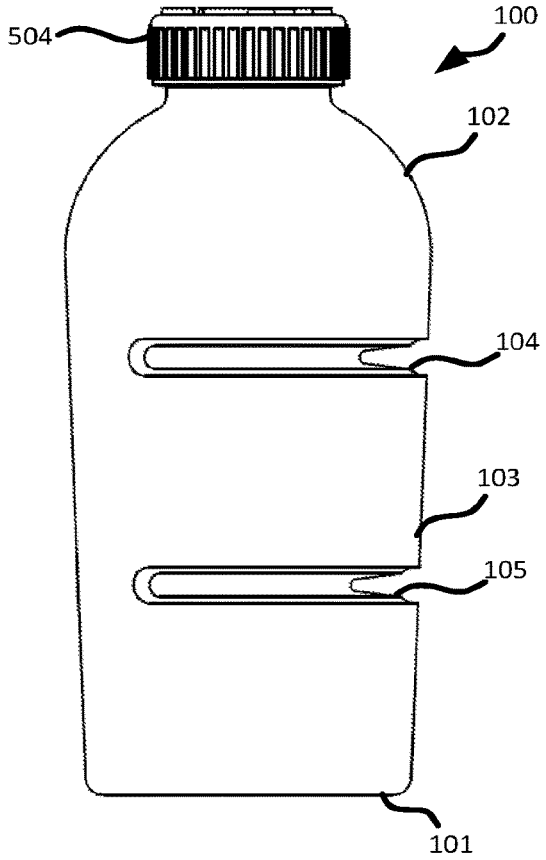
FIG. 8 is a side view of the bottle of FIG. 1 with a cap.
Figure 10:
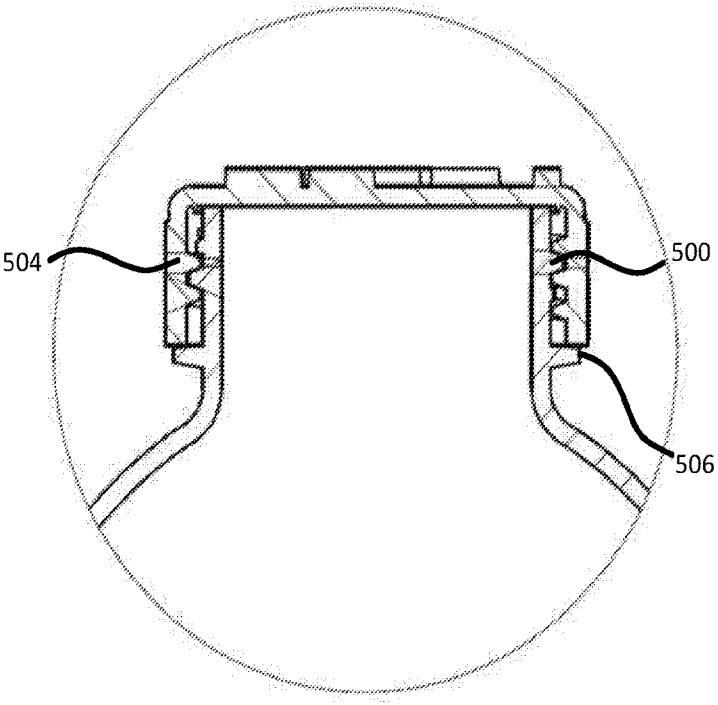
FIG. 10 is a detail view of the neck of the bottle of FIG. 10 with a cap.
Figure 9:
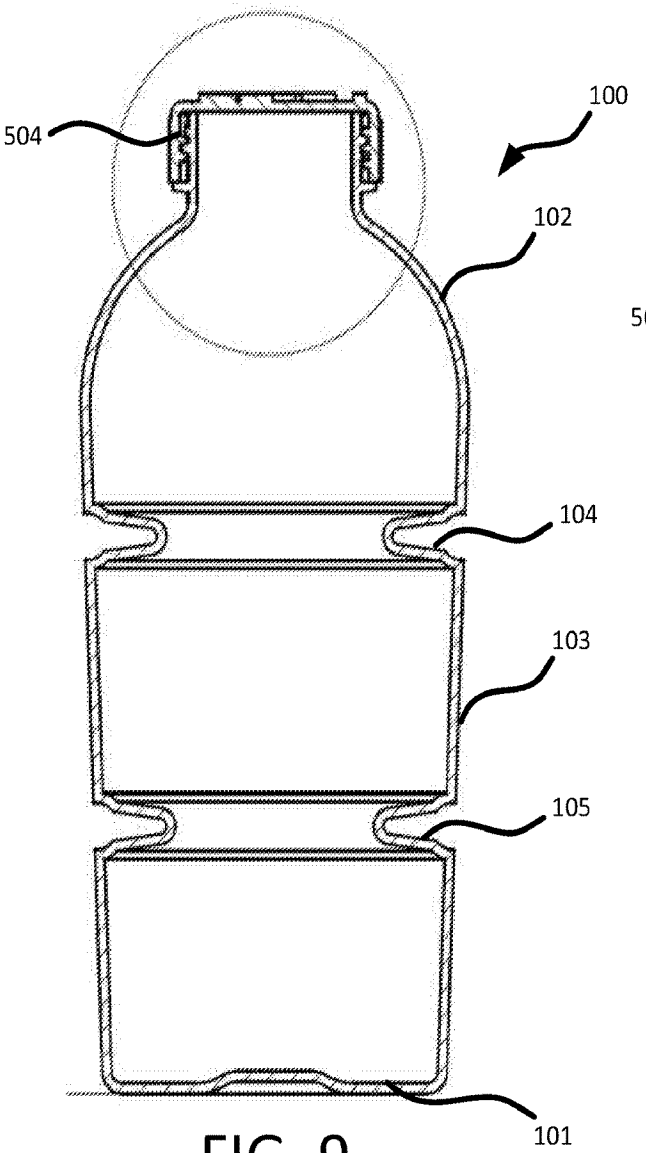
FIG. 9 is a back cross-sectional view of the bottle of FIG. 1 with a cap.

FIGS. 8-10 are various views of the bottle 100 with threads 500 or a cap 504. The cap 504 spins onto the threads 500 seen in FIG. 7. The design of the cap 504 can vary. However, the combination of the cap 504 and threads 500 are configured to minimize spilling out the aperture 113 because a consumer can shake the bottle 100 to mix a powder and liquid.

While a cap 504 is illustrated, other types of caps or snap tops are possible.

Figure 11:
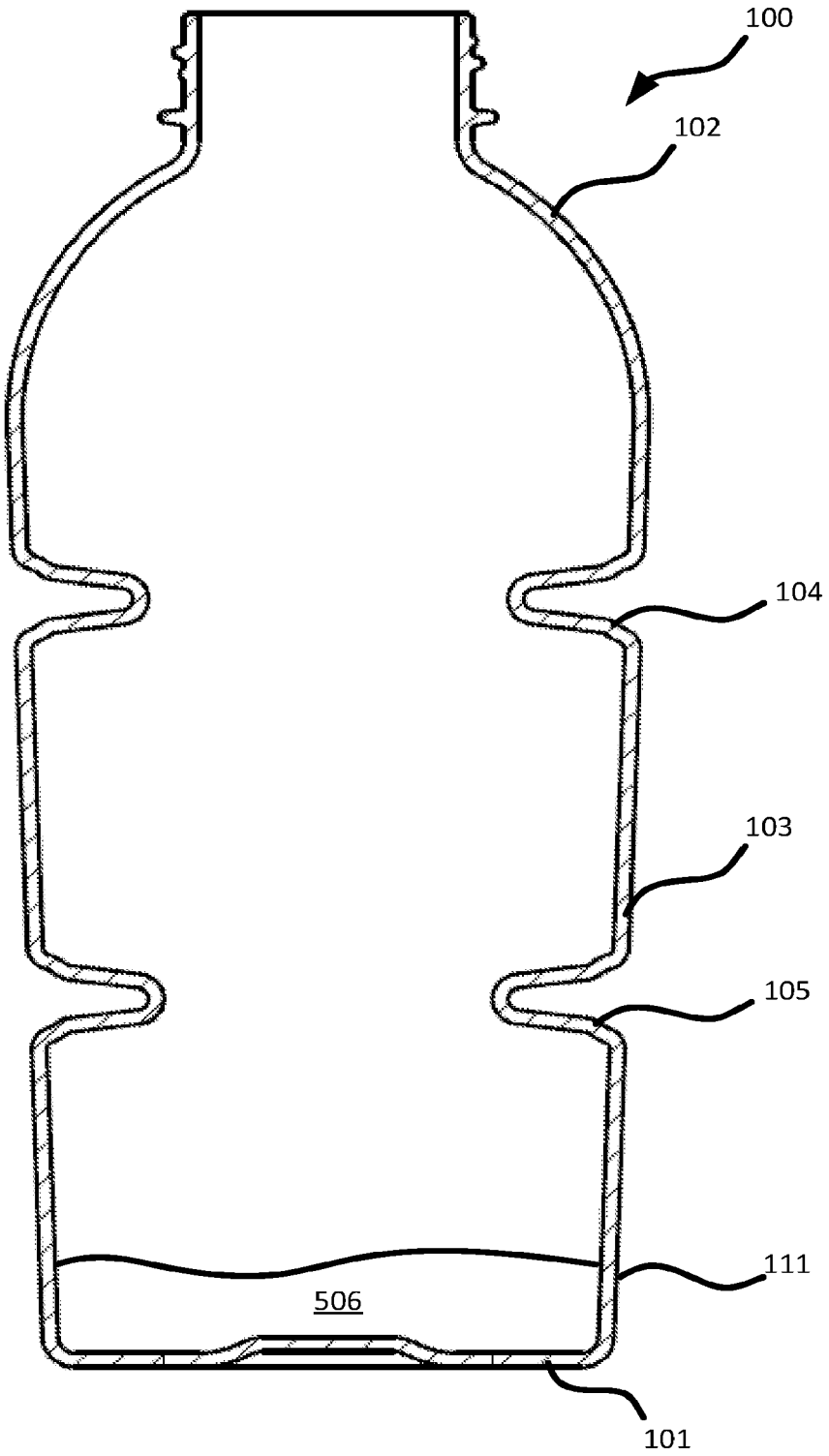
FIG. 11 is a cross-sectional view of the bottle of FIG. 1 along line A-A in FIG. 2 with powder.

FIG. 11 is a cross-sectional view of the bottle 100 of FIG. 1 along line A-A with powder 506. The amount of powder 506 that a bottle 100 is filled with can vary depending on the desired mixture or type of powder 506. In an example approximately 1.1 ounces (31 grams) of protein powder are added to the bottle 100, which may occupy a volume of approximately 1.09 fluid ounces (0.03 liters). The amount of liquid, such as water or milk, that is added to the bottle 100 can vary depending on a consumer's taste. If a consumer prefers a thinner protein shake, then more liquid will be added to the protein powder. If a consumer likes a thicker protein shake, then less liquid will be added to the protein powder.

In an example, approximately 200 mL (6.7628 fluid ounces) of water is added to approximately 1.1 ounces (31 grams) of protein powder in the bottle 100. This can vary by the type of protein powder and is merely one example.

Figure 12:
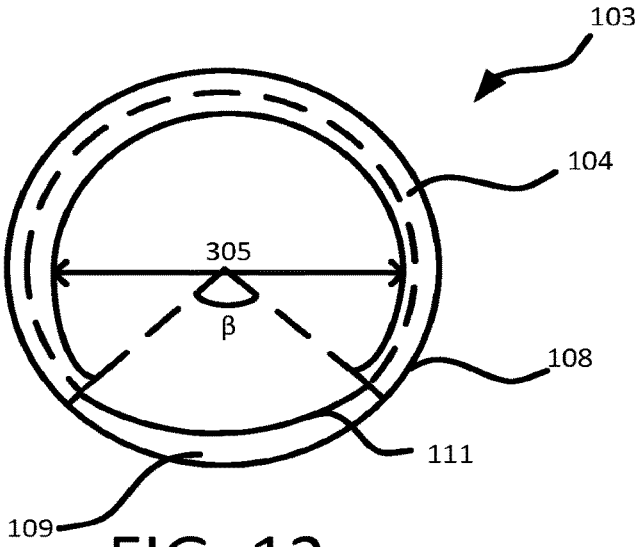
FIG. 12 is a cross-sectional view of an embodiment of the indent circumference in accordance with the present disclosure.
Figure 13:
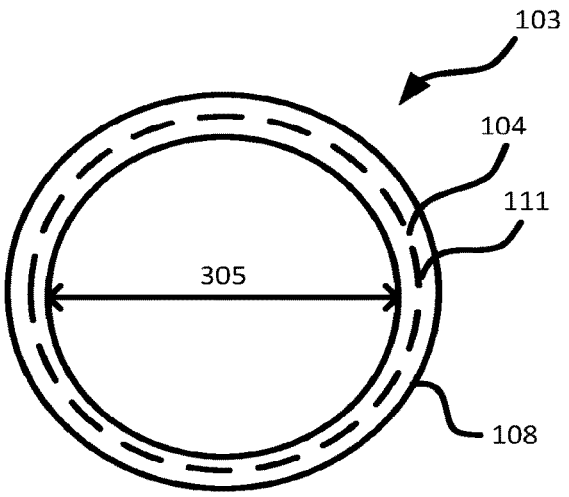
FIG. 13 is a cross-sectional view of another embodiment of the indent circumference in accordance with the present disclosure.
Figure 14:
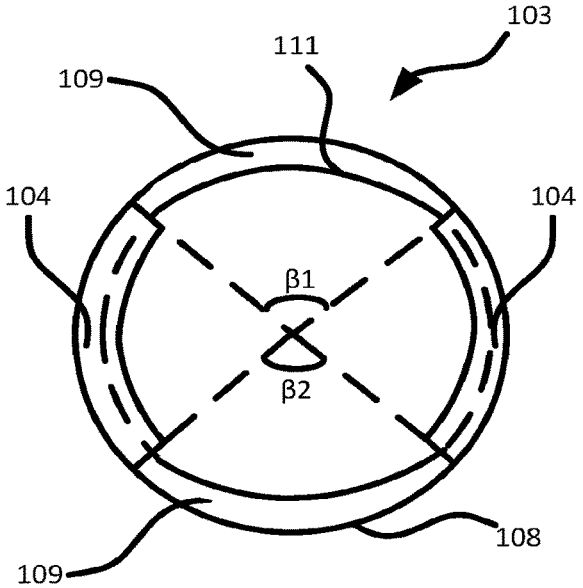
FIG. 14 is a cross-sectional view of yet another embodiment of the indent circumference in accordance with the present disclosure.

FIGS. 12-14 illustrate cross-sectional view of indent circumferences. While the first indent 104 with a first inner diameter 305 is illustrated, FIGS. 12-14 also can apply to other indents, such as the second indent 105.

In FIG. 12, the first indent 104 extends around approximately 75% of the circumference of the body 103 (or approximately 270°). This provides a region 109. β in FIG. 12 is approximately 90°. β can be other values. For example, β can be from approximately 1° to 355°. In an instance, β is approximately 5°.

In FIG. 13, the first indent 104 extends around an entirety of the circumference of the body 103. Thus, the inner surface 111 is shown in outline. Use of a first indent 104 that extends around the entire circumference of the body 103 would prevent use of the region 109. This can still provide a bottle that a consumer can consume or pour a mixture from. For example, a bottle 100 with a smaller neck may accommodate a first indent 104 that extends around the entire circumference of the body 103. In an instance where the first indent 104 overlaps at its ends (e.g., a spiral pattern), the first indent 104 extends around more than 360° of the body 103.

In FIG. 14, two first indents 104 each extend partway around the circumference of the body 103. This provides two regions 109, represented by β1 and β2. β1 and β2 can be from, for example, 5° to 175°. β1 and β2 can have the same or different values and may both be, for example, 90°. Other values for 131 and β2 are possible. The position of β1 and β2 relative to the circumference can vary from that illustrated in FIG. 14. Other numbers of first indents 104 also are possible and the bottle 100 is not limited to just two first indents 104 as illustrated in FIG. 15.

Figure 15:
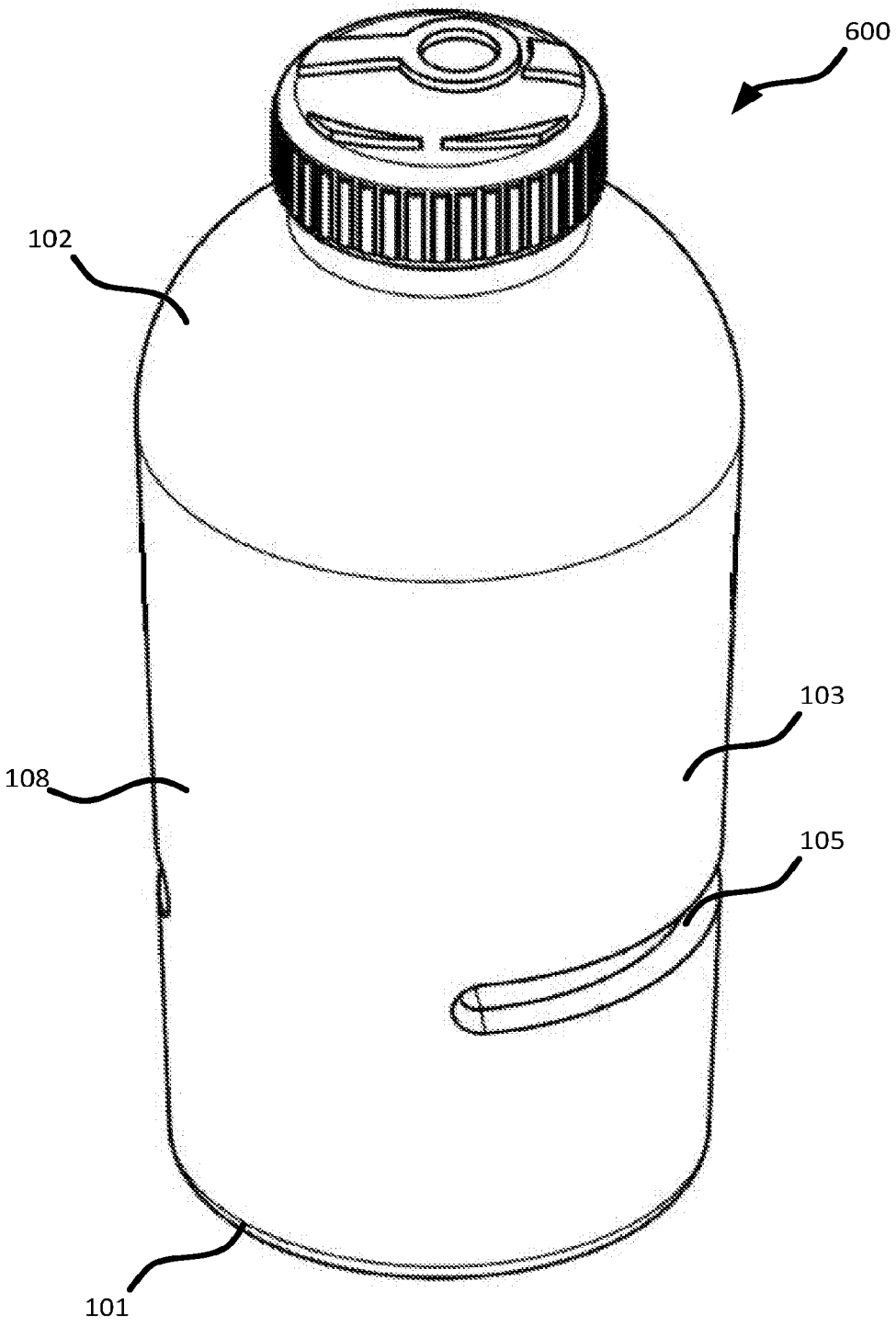
FIG. 15 is a perspective view of a second embodiment of a bottle in accordance with the present disclosure.

FIG. 15 is a perspective view of a bottle 600. The bottle 600 only includes the second indent 105. The dimensions of the second indent 105 are configured such that the bottle 600 can provide sufficient mixing of, for example, a liquid and a powder. The position of the second indent 105 on the body 103 relative to the base 101 or neck 102 can vary from that illustrated in FIG. 15.

Figure 16:
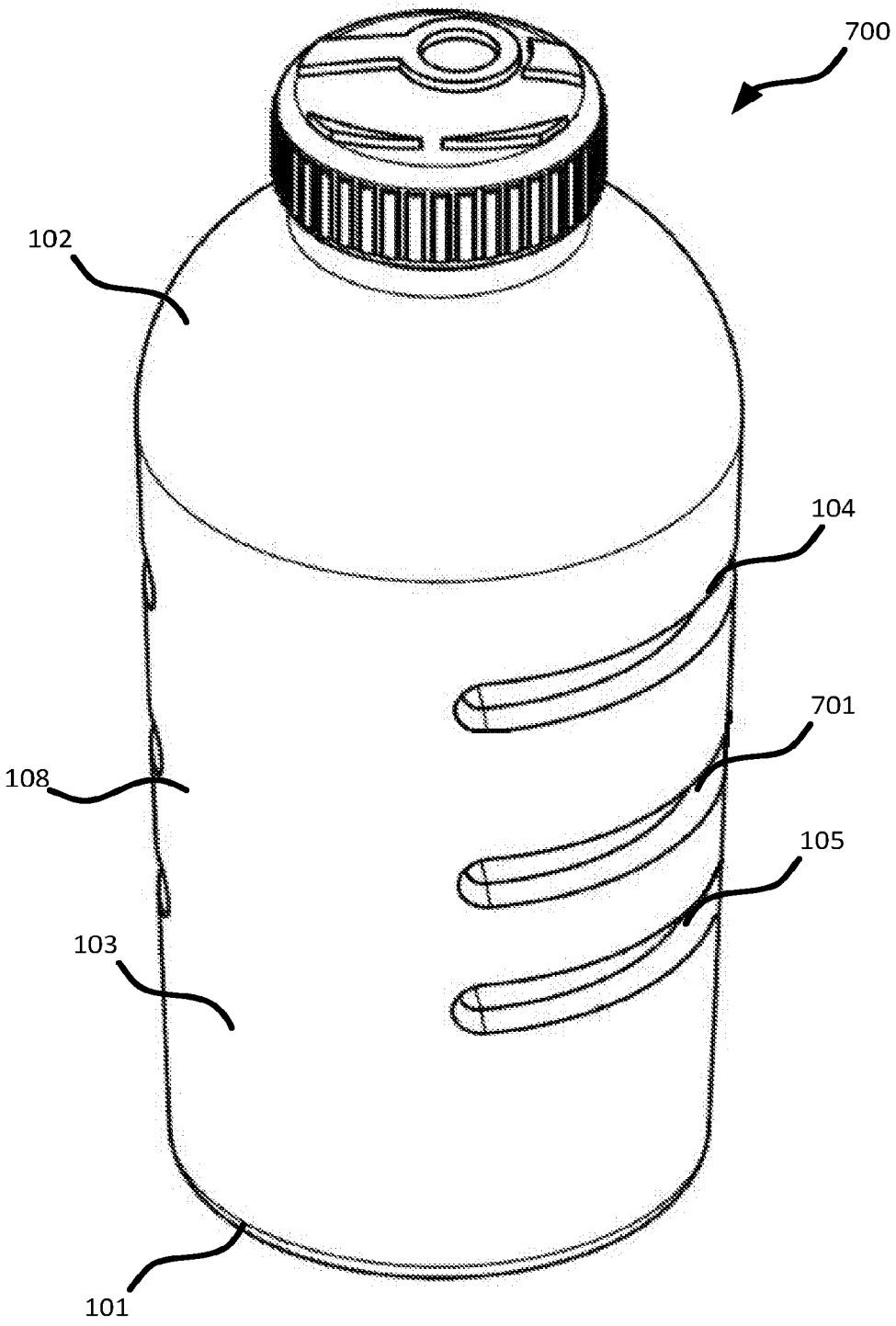
FIG. 16 is a perspective view of a third embodiment of a bottle in accordance with the present disclosure.

FIG. 16 is a perspective view of a bottle 700. The bottle 700 includes a first indent 104, second indent 105, and third indent 701. The dimensions and spacing of the first indent 104, second indent 105, and third indent 701 are configured such that the bottle 700 can provide sufficient mixing of, for example, a liquid and a powder. The position of the first indent 104, second indent 105, or third indent 701 on the body 103 relative to the base 101 or neck 102 can vary from that illustrated in FIG. 16.

While FIG. 16 illustrates up to three indents, more indents are possible. A bottle may have from one to fifty indents. For example, a bottle can have four, ten, twenty, or fifty indents. The dimensions of each indent can vary. The spacing between the indents also can vary. The dimensions and/or spacing of the indents may be configured to reduce clumps of powder from becoming stuck between indents.

A bottle with two indents, such as the first indent 104 and second indent 105, may provide improved mixing of the powder and liquid. Each of the indents acts as an agitator to provide a smooth mixture and prevent clumping. More or fewer indents may be used to provide similar improved mixing of the powder and liquid.

While not illustrated, an indent also can be added to or extend to the neck 102.

It should be noted that any of the embodiments of the bottle 100 also can apply to the bottle 600, bottle 700, or other bottle configurations.

Embodiments of the bottle disclosed herein can include one or more markers to designate particular fill levels. This can help a consumer have the desired ratio of liquid and powder. In an instance, the indent in the bottle also serves as a marker to designate a particular fill level. In another instance, a separate indent or line is used to designate a particular fill level. This separate indent to designate a particular fill level may or may not be configured to agitate a substance contained in the bottle.

Figure 17:
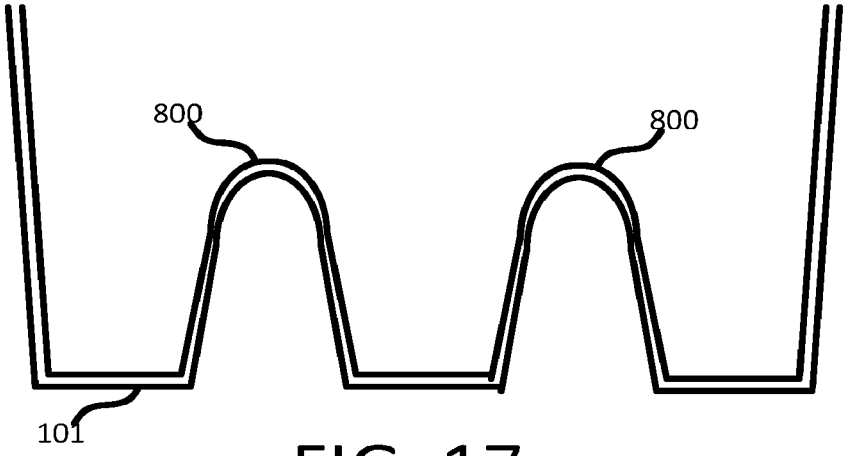
FIG. 17 is a cross-sectional view of a baffle in accordance with the present disclosure.

FIG. 17 is a cross-sectional view of a baffle 800. The baffle 800 may be positioned in the base 101. While illustrated as a hollow ring projecting into the interior of a bottle (e.g., like a first indent 104 or second indent 105), the baffle 800 also could have other designs or more than one baffle 800 or type of baffle may be present in the base 101. For example, the baffle 800 can be a series of bumps or projections on or in the base 101 or other designs. The baffle 800 can aid in mixing the powder and liquid.

Figure 18:
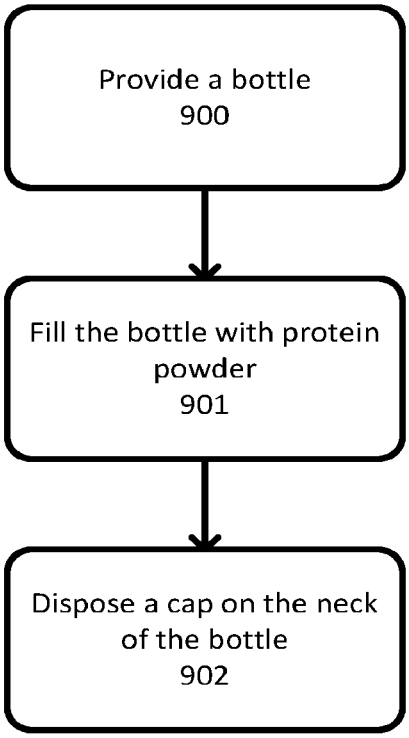
FIG. 18 is a flowchart in accordance with the present disclosure.

FIG. 18 is a flowchart. In 900, a bottle is provided. This bottle may be, for example, the bottle 100, bottle 600, bottle 700, or other bottle designs in accordance with the present disclosure. In 901, the bottle is filled with protein powder. In an example, the protein powder occupies less than 10% of a volume of the interior of the bottle after the filling and before the cap is disposed on the neck of the bottle. In an example, the protein powder occupies less than 40% of a volume of the interior of the bottle after the filling and before the cap is disposed on the neck of the bottle. The amount of powder can vary based on the type of powder, the intended thickness of the desired mixture, or the volume of fluid needed for the intended mixture. In 902, a cap is disposed on the neck of the bottle. The bottle may be packed or shipped after the cap is disposed on the neck of the bottle.

A consumer fills the bottle, such as the bottle 100, bottle 600, bottle 700, or other bottle designs in accordance with the present disclosure, with a liquid like water or milk. The consumer then shakes the bottle to mix the liquid and powder, such as protein powder, and drinks, pours, or otherwise consumes the mixture.

Embodiments of the bottle disposed herein are configured to be single-use. In a single-use embodiment, a consumer mixes a liquid with a powder, pours, drinks, or otherwise consumes the mixture, and disposes of the bottle. These bottles can be recyclable or otherwise disposable after the single use.

Other embodiments of the bottle disclosed herein are configured to be reusable (e.g., provide more than one use). For example, a consumer can rinse or otherwise clean an embodiment of the bottle disclosed herein and add more powder and liquid as needed. A bottle that is configured to be reusable may or may not be shipped with powder or other substances for mixing inside.

The bottle 100 was tested and demonstrated surprisingly superior results compared to a standard disposable water bottle. The same amount of protein powder was added to a standard disposable water bottle and a bottle 100 with a first indent 104 and second indent 105. Then the same amount of water was added to the disposable water bottle and the bottle 100. A timed shake of approximately 15 seconds for the disposable water bottle and a timed shake of approximately 10 second for the bottle 100 was performed. Approximately the same mixing force was applied to the disposable water bottle and the bottle 100. Then the contents of the disposable water bottle and the bottle 100 were poured onto a tray. Unexpectedly and in spite of the longer shake, the contents of the disposable water bottle still contained undesirable clumps. The contents of the bottle 100 contained no observable clumps and resulted in a mixture that was smoother than the contents of the standard disposable water bottle. The indents in the bottle 100 provide improved mixing capability compared to the standard disposable water bottle that lacked indents like the bottle 100 because the indents agitate a substance contained in the bottle 100.

The bottles disclosed in the embodiments herein, including the base, neck, and body, can be made of different materials or blends of materials. These materials include high-density polyethylene (HDPE), polyethylene terephthalate (PET), polyvinyl chloride (PVC), polypropylene (PP), low density polyethylene (LDPE), plant-based plastics, other bioplastics, or other biodegradable plastics. These materials also can include metals, such as aluminum, or glass.

A tapered bottle shape can reduce material used in manufacturing. A bottle with a perfectly cylindrical body (other than the indents) may need more material for manufacturing, but may provide advantages when packing or shipping.

The embodiments of the bottle disclosed herein have a generally round cross-section. Other shapes, such as oval, are possible.

Embodiments of the bottle disclosed herein can be manufactured using extrusion blow molding, injection molding, casting, or other manufacturing processes.

While protein powder is disclosed as a powder used to fill an embodiment of a bottle disclosed herein, other powders are possible. For example, the powder can be baby formula, sports drinks, iced tea, other powdered drinks (e.g., fruit-flavored drinks for children), or medication. The powder may be prone to clumping. For example, protein powder and baby formula are both prone to clumping and may benefit from the embodiments of the bottle disclosed herein. The bottle shape or size may vary to accommodate some of these different powders. For example, a bottle configured for baby formula may be smaller than one for protein powder used by adults.

While powder is disclosed, embodiments of the bottle disclosed herein also can be filled with a liquid, one or more pellets, one or more beads, or a gel instead of a powder. The contents of the bottle can be mixed with, for example, a liquid, a powder, pellets, beads, or a gel to result in a liquid mixture, some other viscous mixture, or gel. Embodiments of the bottle disclosed herein also can filled with other combinations of powders, pellets, beads, gels, or liquids.

Although the present disclosure has been described with respect to one or more particular embodiments, it will be understood that other embodiments of the present disclosure may be made without departing from the scope of the present disclosure. Hence, the present disclosure is deemed limited only by the appended claims and the reasonable interpretation thereof.

What is claimed is:

1. A bottle comprising:

a base;

a neck defining an aperture;

a body having a circumference and extending between the base and the neck, the body further defined by a wall having an outer surface and an inner surface having a radius measured from a center of the bottle, the circumference of the body including a first portion that is unobstructed between the neck and the base and a second portion with a changing inner radius to the center of the bottle;

a first indent into the second portion of the circumference and projecting a first distance into the interior to define a first inner diameter, the first indent defined by a first upper planar region, a first lower planar region, and a first tip defining a furthest depth into the interior that the first indent projects, the first upper planar region and the first lower planar region extending between the circumference of the body and the first tip; and a second indent into the second portion of the circumference and projecting a second distance into the interior to define a second inner diameter, the second indent defined by a second upper planar region, a second lower planar region, and a second tip defining a furthest depth into the interior that the second indent projects, the second upper planar region and the second lower planar region extending between the circumference of the body and the second tip, wherein the first distance and the second distance are each at least 50% of a radius extending from the center of the bottle to the inner surface of the bottle, as measured in a plane at the first indent.

2. The bottle of claim 1, wherein the first distance and the second distance are different.

3. The bottle of claim 1, wherein the first distance and the second distance are the same.

4. The bottle of claim 1, wherein the base, the neck, and the body are fabricated of HDPE plastic.

5. The bottle of claim 1, wherein the inner surface of the body has a first diameter where the body connects with the neck and a second diameter where the body connects with the base, and wherein the second diameter is smaller than the first diameter.

6. The bottle of claim 1, wherein the first tip and the second tip are rounded.

7. The bottle of claim 1, wherein the first indent and second indent project into the interior at an angle substantially parallel to a planar surface of the base.

8. The bottle of claim 1, wherein the body has a wall thickness from 0.8 mm to 2 mm.

9. The bottle of claim 1, wherein:

the first upper planar region and the first lower planar region extend towards the first tip at an angle of between 3 and 15 degrees relative to one another; and the second upper planar region and the second lower planar region extend towards the second tip at an angle of between 3 and 15 degrees relative to one another.

10. The bottle of claim 1, wherein the first indent and the second indent are each substantially parallel with a planar surface of the base.

11. A bottle comprising:

a base;

a neck defining an aperture;

a body having a circumference and extending between the base and the neck, the body further defined by a wall having an outer surface and an inner surface having a radius measured from a center of the bottle, the circumference of the body including a first portion that is unobstructed between the neck and the base and a second portion with a changing inner radius to the center of the bottle;

a first indent into the second portion of the circumference and projecting a first distance into the interior to define a first inner diameter, the first indent defined by a first upper planar region, a first lower planar region, and a first tip defining a furthest depth into the interior that the first indent projects, the first upper planar region and the first lower planar region extending between the circumference of the body and the first tip; and a second indent into the second portion of the circumference and projecting a second distance into the interior to define a second inner diameter, the second indent defined by a second upper planar region, a second lower planar region, and a second tip defining a furthest depth into the interior that the second indent projects, the second upper planar region and the second lower planar region extending between the circumference of the body and the second tip, wherein:

the first distance and the second distance are each at least 15% of a radius from the center of the bottle to the inner surface of the bottle as measured in a plane at the first portion; and the first inner diameter and the second inner diameter are each larger than a diameter of the aperture.

12. The bottle of claim 11, wherein the first distance and the second distance are different.

13. The bottle of claim 11, wherein the first distance and the second distance are the same.

14. The bottle of claim 11, wherein the base, the neck, and the body are fabricated of HDPE plastic.

15. A bottle comprising:

a base;

a neck defining an aperture;

a body having a circumference and extending between the base and the neck, the body further defined by a wall having an outer surface and an inner surface having a radius measured from a center of the bottle, the circumference of the body including a first portion that is unobstructed between the neck and the base and a second portion with a changing inner radius to the center of the bottle;

a first indent into the second portion of the circumference and projecting a first distance into the interior to define a first inner diameter, the first indent defined by a first upper planar region, a first lower planar region, and a first tip defining a furthest depth into the interior that the first indent projects, the first upper planar region and the first lower planar region extending between the circumference of the body and the first tip; and a second indent into the second portion of the circumference and projecting a second distance into the interior to define a second inner diameter, the second indent defined by a second upper planar region, a second lower planar region, and a second tip defining a furthest depth into the interior that the second indent projects, the second upper planar region and the second lower planar region extending between the circumference of the body and the second tip, wherein:

the first distance and the second distance are at least 15% of a radius from the center of the bottle to the inner surface of the bottle as measured in a plane at the first portion;

a first height of the first indent, as measured between the first lower planar region and the first upper planar region proximate the outer surface of the body, is less than the first distance; and a second height of the second indent, as measured between the second lower planar region and the second upper planar region proximate the outer surface of the body, is less than the first distance.

16. The bottle of claim 15, wherein the first distance and the second distance are different.

17. The bottle of claim 15, wherein the first distance and the second distance are the same.

18. The bottle of claim 15, wherein the base, the neck, and the body are fabricated of HDPE plastic.

* * * * *